US006698496B2

(12) United States Patent
Takayama et al.

(10) Patent No.: US 6,698,496 B2
(45) Date of Patent: Mar. 2, 2004

(54) COOLING ARRANGEMENT FOR DIE-CASTING METAL MOLD

(75) Inventors: Tomoyuki Takayama, Ihara-gun (JP); Takuma Takahashi, Ihara-gun (JP); Mutsumi Sano, Ihara-gun (JP)

(73) Assignee: Ryobi Ltd., Hiroshima-ken (JP)

( * ) Notice: Subject to any disclaimer, the term of this patent is extended or adjusted under 35 U.S.C. 154(b) by 0 days.

(21) Appl. No.: 10/311,635

(22) PCT Filed: Jun. 29, 2001

(86) PCT No.: PCT/JP01/05611

§ 371 (c)(1),
(2), (4) Date: Dec. 18, 2002

(87) PCT Pub. No.: WO02/00375

PCT Pub. Date: Mar. 1, 2002

(65) Prior Publication Data

US 2003/0168199 A1 Sep. 11, 2003

(30) Foreign Application Priority Data

Jun. 29, 2000 (JP) ..... 2000-195717

(51) Int. Cl.[7] ..... B22D 27/04; B22D 17/00
(52) U.S. Cl. ..... 164/312; 164/348; 164/443
(58) Field of Search ..... 164/312, 348, 164/122, 113, 443, 485

(56) References Cited

U.S. PATENT DOCUMENTS 3,973,617 A * 8/1976 Berkowitz ..... 164/113
6,312,628 B1 * 11/2001 Wieder et al. ..... 264/37.27

FOREIGN PATENT DOCUMENTS

JP 64-27920 1/1989
JP 7-185769 7/1995

* cited by examiner

*Primary Examiner*—Tom Dunn
*Assistant Examiner*—Ing-Hour Lin
(74) *Attorney, Agent, or Firm*—McGuireWoods LLP

(57) ABSTRACT

A cooling arrangement for uniformly cooling an entirety of a die-casting metal mold is provided. Cooling oil is supplied from temperature controllers (9, 10) by pumps to respective coolant passages (A,B,C,D,E,F,G) through coolant supply circuits (5,6) and through manifolds (5B,6B) where the coolant is branched for cooling a predetermined portion of the metal mold (2). Then, the cooling oil discharged from the respective coolant passages (A,B,C,D,E,F,G) are returned to the temperature controllers (9,10) through coolant discharge passages (7,8) and is cooled by cooling device (11, 12). The cooled cooling oil is again supplied to the coolant supply circuits (5,6). The coolant passages (A through G) are grouped into two groups, and the temperature controllers and the coolant circulation circuits are also grouped into each group to perform coolant supply control and temperature control independently of each group.

2 Claims, 7 Drawing Sheets

COOLING ARRANGEMENT FOR DIE-CASTING METAL MOLD

CROSS-REFERENCE TO RELATED APPLICATION

This application is a 371 of PCT/JP01/05611 filed on Jun. 29, 2001.

TECHNICAL FIELD

The present invention relates to a cooling arrangement for a die-casting metal mold, and more particularly, to such a cooling arrangement capable of uniformly cooling the entirety of the die-casting metal mold.

BACKGROUND ART

A conventional cooling arrangement for a die-casting metal mold is described in Laid-open Japanese Patent application Publication No. Sho-58-211405. In the disclosed arrangement, a coolant passage is penetratingly formed in the metal mold. The passage has one open end connected to a coolant accumulation tank through a coolant inlet pipe, and has another open end connected to the tank through a coolant outlet pipe. A pump is provided at the coolant outlet pipe. Upon actuation of the pump, the coolant in the tank is introduced into the coolant passage in the metal mold through the coolant inlet pipe, and is then circulated to the tank through the coolant outlet pipe. A temperature of the coolant in the tank is controlled by a tank temperature controller for supplying the coolant at its optimum temperature to the die-casting metal mold.

Laid-open Japanese Patent Application Publication No. Hei-6-71408 discloses a method for forming a coolant passage in a die-casting metal mold. According to the disclosed method, a continuous deep groove is formed by a cut machining at a surface opposite to a mold cavity, and a lid is covered over the formed groove to provide a coolant passage. This method is designed to overcome the deficiency in a conventional drilling where a desirable configuration and orientation of the passage cannot be provided.

Further, still another conventional cooling arrangement is shown in FIG. 7 in which a linear cooing bore 130 is bored from a surface opposite to a mold cavity 125 to a position adjacent to the mold cavity 125, and a coolant supply pipe 105 extends through and generally concentrically with the cooling bore 130. A coolant is supplied through the coolant supply pipe 105 in a direction indicated by an arrow in FIG. 7. The supplied coolant passes through a space defined between an inner peripheral surface of the cooling bore 130 and an outer peripheral surface of the coolant supply pipe 105, and is then discharged through a coolant discharge pipe 107. Thus, the metal mold can be locally cooled by a linear coolant passage extending in a depthwise direction (thickness direction) of the metal mold.

However, in these conventional cooling arrangements, water is generally employed as the coolant. In such a case, clogging of the coolant passage may occur due to deposition of fur on the coolant passage or cooling efficiency may be excessively lowered due to boiling of the water, if the coolant passage is located adjacent to the mold cavity. In view of this reason, the coolant passage must be positioned away from the mold cavity by a predetermined distance.

Further, if a cross-sectional area of the coolant passage is insufficiently small, it would be impossible to cool a wide range of the mold cavity simultaneously, and therefore, it would be difficult to uniformly cool the entirety of the mold cavity.

Furthermore, in a conventional cooling arrangement, only one coolant passage is formed in the mold cavity. In this connection, a coolant adjacent to the coolant inlet has a low temperature, whereas a coolant adjacent to the coolant outlet has a high temperature, which cannot uniformly cool the entirety of the mold cavity at an even temperature. Moreover, a region of the mold cavity and ambient region thereof cannot be uniformly cooled with the only one coolant passage. That is, it would be difficult to uniformly distribute the passage along the mold cavity due to a three dimensional construction of the mold cavity.

Therefore, it is an object of the present invention to provide a cooling arrangement capable of uniformly cooling an entire region of the die-casting metal mold.

DISCLOSURE OF INVENTION

In order to attain the object, the present invention provides a cooling arrangement 1 for cooling a die-casting metal mold 2 having a stationary die 24 and a movable die 22 defining a mold cavity 25 in combination with the stationary die 24, the cooling arrangement including coolant passage means formed in an interior of the die-casting metal mold 2 for allowing a coolant to pass therethrough for cooling the die-casting metal mold 2, the improvement wherein the coolant is made from an oil, and the coolant passage means comprises a plurality of coolant passages A,B,C,D,E,F,G formed at least in the movable die 22, and each of the coolant passages A,B,C,D,E,F,G is defined by a deep and wide groove 30,32,34,36,38 and a partitioning plate 31,33, 35,37,39 disposed in the groove 30,32,34,36,38, each groove 30,32,34, 36,38 and each partitioning plate 31,33, 35,37,39 having shapes in conformance with a shape of the mold cavity 25 and being positioned adjacent thereto, and a temperature controller 9,10 with a cooling device 11,12 is connected to each coolant passage A,B,C,D,E,F,G, and the plurality of coolant passages A,B,C,D,E are grouped into a plurality of groups (A,B,C,D) and (E,F,G), and necessary numbers of the temperature controllers 9,10 are provided in accordance with the numbers of the groups to provide, for each group, a coolant circulation circuit 3,4 including a coolant supply circuit 5,6 and a coolant discharge circuit 7,8 with the associated temperature controller 9,10, whereby cooling control is performed independent of each group (A,B,C,D) and (E,F,G).

With the cooling arrangement for cooling the die-casting metal mold, clogging of the coolant passage with the fur can be prevented, and excessive lowering of the cooling performance due to boiling of the coolant can be avoided, since oil is used as the coolant. Further, an entire die-casting product can be uniformly cooled, since the coolant passage can be positioned close to the mold cavity and since the mold cavity surface can be uniformly cooled by supplying the coolant in an extensive region. As a result, shot cycle can be remarkably shortened. Further, difference in a temperature at or around the coolant supply circuit and a temperature at or around the coolant discharge circuit can be severely taken into consideration for attaining more uniform cooling to the mold product because of the formation of the plurality of coolant passages.

Further, the plurality of the coolant passages are grouped into a plurality of groups, and the temperature controllers are provided in correspondence to the groups, and the coolant circulation circuit constituted by the coolant supply circuit and the coolant discharge circuit is provided in association with the temperature controller for controlling cooling independent of each group. Therefore, a desired portion of the metal mold can be cooled, and control to the temperature of the coolant and control to the supply of the coolant can be performed independently of each group. Consequently, more precise cooling control can be achieved.

In another aspect of the invention, there is provided a cooling arrangement 1 for cooling a die-casting metal mold 2 having a stationary die 24 and a movable die 22 defining a mold cavity 25 in combination with the stationary die 24, the cooling arrangement including coolant passage means formed in an interior of the die-casting metal mold 2 for allowing a coolant to pass therethrough for cooling the die-casing metal mold 2, the improvement wherein the coolant is made from an oil, and the coolant passage means comprises a plurality of coolant passages A,B,C,D,E,F,G formed at least in the movable die 22, and each of the coolant passages A,B,C,D,E,F,G is defined by a deep and wide groove 30,32,34,36,38 and a partitioning plate 31,33, 35,37,39 disposed in the groove 30,32,34,36,38, each groove 30,32,34, 36,38 and each partitioning plate 31,33, 35,37,39 having shapes in conformance with a shape of the mold cavity 25 and being positioned adjacent thereto, the partitioning plate 31,33,35 37,39 having an outer surface formed with at least one auxiliary path 31*e*,31*f*,31*g*,33*e*,33*f* at a position adjacent to the mold cavity 25 to provide a branch flow of the coolant in each coolant passage A,B,C, D,E,F,G, and a temperature controller 9,10 with a cooling device 11,12 is connected to each coolant passage A,B,C, D,E,F,G.

With the cooling arrangement for cooling the die-casting metal mold, clogging of the coolant passage with the fur can be prevented, and excessive lowering of the cooling performance due to boiling of the coolant can be avoided, since oil is used as the coolant. Further, an entire die-casting product can be uniformly cooled, since the coolant passage can be positioned close to the mold cavity and since the mold cavity surface can be uniformly cooled by supplying the coolant in an extensive region. As a result, shot cycle can be remarkably shortened. Further, difference in a temperature at or around the coolant supply circuit and a temperature at or around the coolant discharge circuit can be severely taken into consideration for attaining more uniform cooling to the mold product because of the formation of the plurality of coolant passages.

Further, the cooling oil can be distributed to wider area by the formation of the auxiliary path to further promote uniform cooling. The auxiliary path can be easily provided by forming a groove at the outer surface of the partitioning plate.

BEST MODE FOR CARRYING OUT THE INVENTION

Figure 1:
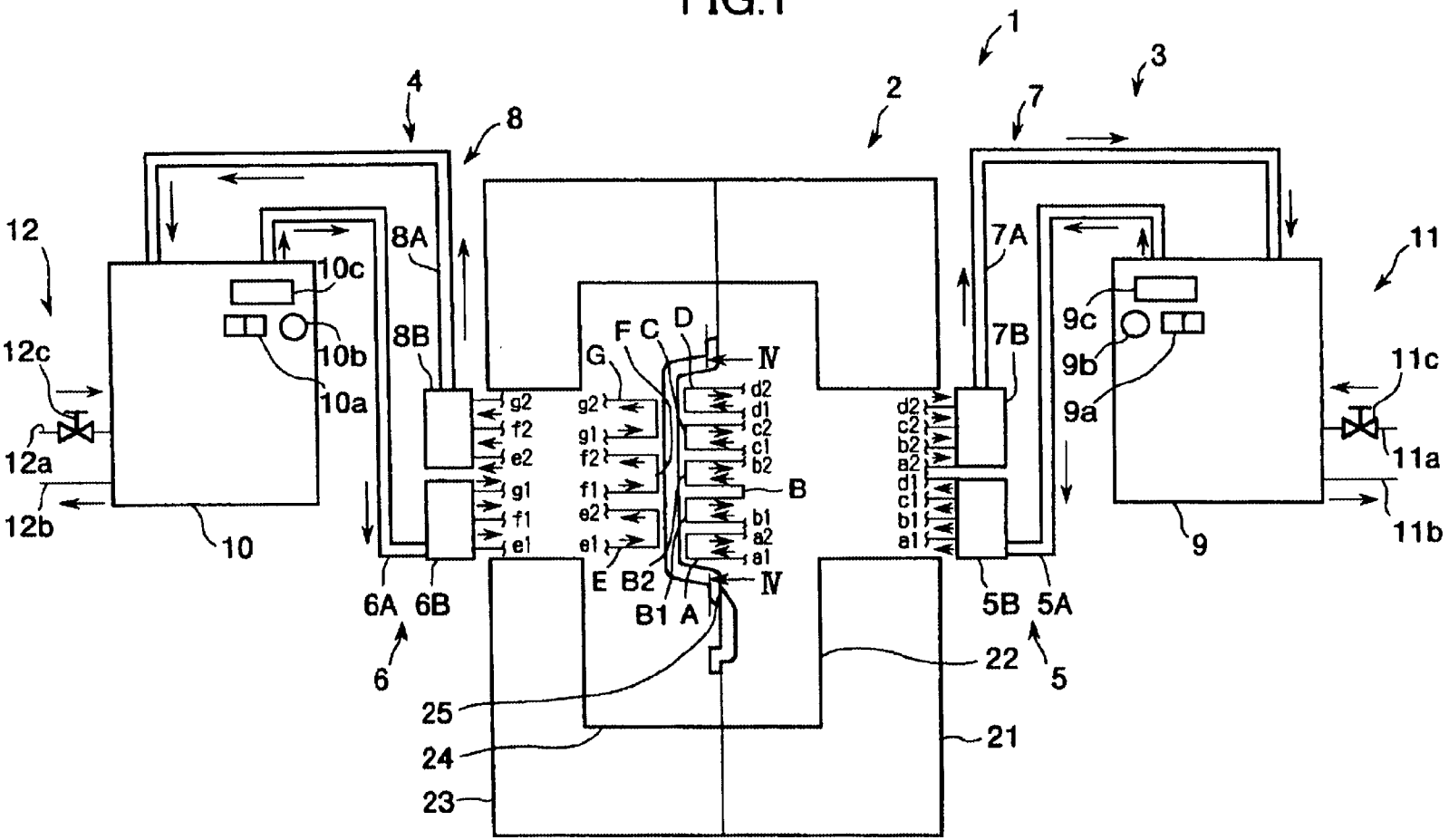
FIG. 1 is a schematic view showing a cooling arrangement for cooling a die-casting metal mold according to one embodiment of the present invention.

A cooling arrangement for cooling a die-casting metal mold according to one embodiment of the present invention will be described with reference to FIGS. 1 through 6. FIG. 1 is a schematic view showing the cooling arrangement according to the embodiment.

Figure 2:
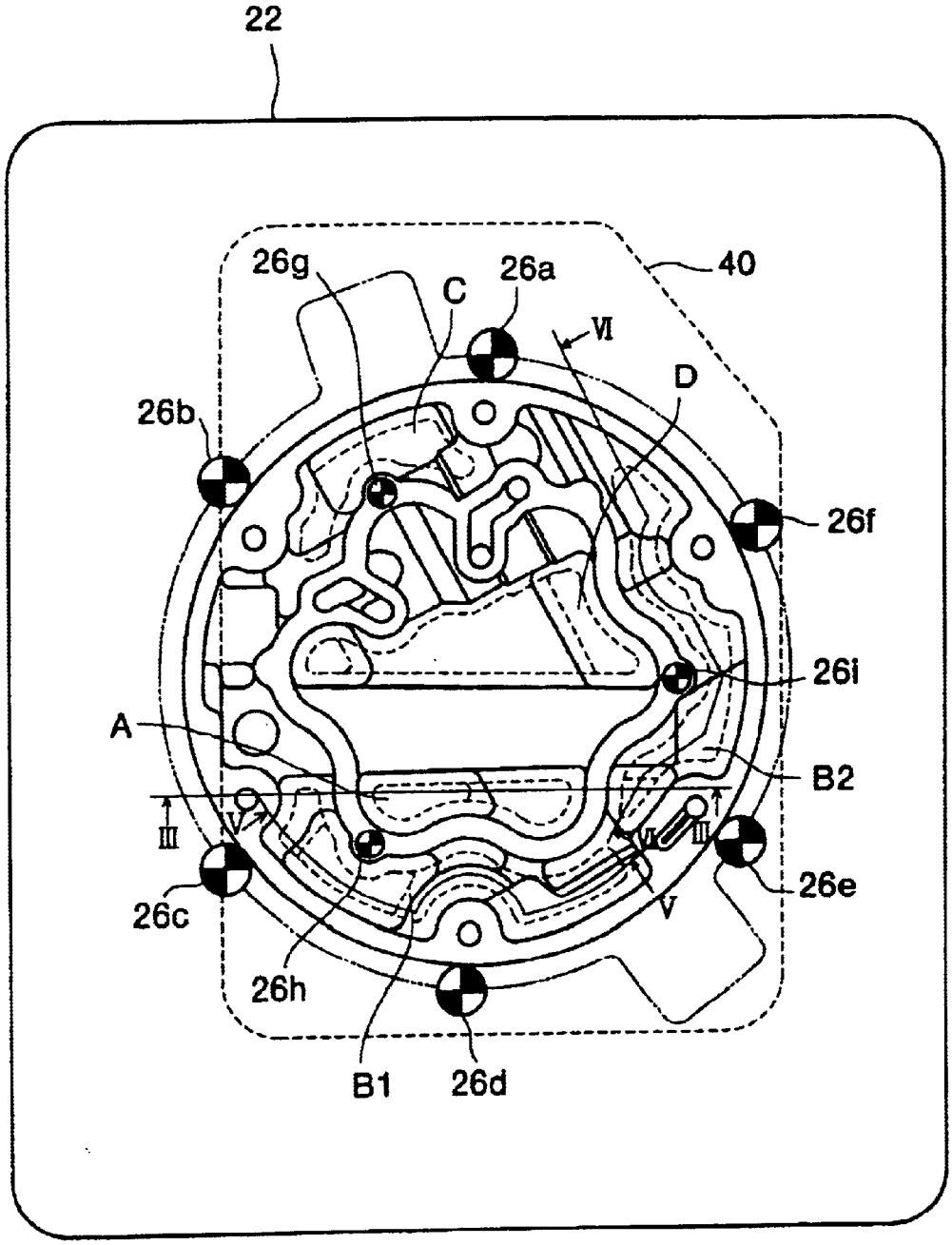
FIG. 2 is a front view showing a movable die provided with the cooling arrangement according to the embodiment of the present invention.

A die-casting metal mold 2 includes a movable die 22 fixed to a movable holder 21, and a stationary die 24 fixed to a stationary holder 23. A mold cavity 25 is defined at confronting surfaces of the movable die 22 and the stationary die 24. As shown in FIG. 2, ejection pins 26*a*, 26*b*, 26*c*, 26*d*, 26*e*, 26*f*, 26*g*, 26*h*, 26*i* are provided at the movable die 22 for ejecting a mold product from the metal mold 2. As described later, a set of a plurality of coolant passages A, B, C, D are formed in the movable die 22, and another set of a plurality of coolant passages E, F, G are formed in the stationary die 24. To these coolant passages A through G, oil is introduced as a coolant for cooling the metal mold 2. Electric spark machining oil, quenching oil, and temperature control oil are preferable as cooling oil.

The coolant passages A, B, C, D at the movable die 22 have inlet side passages a1, b1, c1, d1 and outlet side passages a2, b2, c2, d2. The inlet side passages a1, b1, c1, d1 are connected to an inlet side manifold 5B formed with a plurality of inlet holes. The inlet side manifold 5B is connected to a temperature controller 9 through a supply pipe 5A. The supply pipe 5A and the inlet side manifold 5B constitute a coolant supply circuit 5. The outlet side passages a2, b2, c2, d2 are connected to a discharge side manifold 7B formed with a plurality of discharge holes. The discharge side manifold 7B is connected to the temperature controller 9 through a discharge pipe 7A. The discharge manifold 7B and the discharge pipe 7A constitute a coolant discharge circuit 7. The coolant supply circuit 5 and the coolant discharge circuit 7 constitute a coolant circulation circuit 3.

The temperature controller 9 is provided with ON/OFF switch 9*a* for turning ON and OFF an electric power, a temperature control dial 9*b* for setting a temperature of the cooling oil, and a temperature display 9*c* for displaying a temperature of the cooling oil. Further, a cooling device 11 is connected to the temperature controller 9. The cooling device 10 includes a cooling water supply tube 11*a*, a cooling water discharge tube 11*b*, and a stop valve 11*c* disposed at the cooling water supply tube 11*a*. In the cooling device 10, the cooling water is supplied to the temperature controller 9 through the cooling water supply tube 11*a* for cooling the cooling oil accumulated in an oil tank (not shown) disposed interior of the temperature controller 9. Then, the cooling water is discharged outside through the discharge tube 11*b*. The stop valve 11*c* controls flow rate of the cooling water to be supplied to the temperature controller 9 by controlling opening degree of the valve. The cooling oil is cooled to a temperature set by the temperature control dial 9*b*. In the illustrated embodiment, the cooling oil is cooled to about 20 centigrades.

The coolant passages E, F, G at the stationary die 24 have inlet side passages e1, f1, g1 and outlet side passages e2, f2, g2. The inlet side passages e1, f1, g1 are connected to an inlet side manifold 6B formed with a plurality of inlet holes. The inlet side manifold 6B is connected to a temperature controller 10 through a supply pipe 6A. The temperature controller 10 is exclusively used for the coolant passages E, F, G. The supply pipe 6A and the inlet side manifold 6B constitute a coolant supply circuit 6. The outlet side passages e2, f2, g2 are connected to a discharge side manifold 8B formed with a plurality of discharge holes. The discharge side manifold 8B is connected to the temperature controller 10 through a discharge pipe 8A. The discharge manifold 8B and the discharge pipe 8A constitute a coolant discharge circuit 8. The coolant supply circuit 6 and the coolant discharge circuit 8 constitute a coolant circulation circuit 4. An arrangement of the temperature controller 10 is the same as that of the temperature controller 9. An ON/OFF switch 10*a*, a temperature control dial 10*b*, and a temperature display 10*c* are similarly provided. Further, a cooling device 12 similar to the cooling device 11 is provided. A cooling water supply tube 12*a*, a cooling water discharge tube 12*b* and a stop valve 12*c* are similarly provided. For circulating the coolant through the coolant circulation circuits 3 and 4, pumps (not shown) are provided at the respective coolant circulation circuits.

In this way, in the depicted embodiment, the coolant passages A through G are grouped into two groups, and temperature controllers and coolant circulation circuits 3, 4 are also grouped into the equal number of groups, so that supply control and temperature control of the coolant is performed independently of each group.

Upon actuation of the pump (not shown) the cooling oil passes through the temperature controllers 9, 10 and the coolant supply circuit 5, 6 in which the cooling oil is flowed into a plurality of separate passages at the inlet side manifold 5B, 6B, and are supplied to the respective coolant passages A through G. Accordingly, predetermined portions of the metal mold 2 are cooled. Then, the cooling oil discharged from the respective coolant passages A through G is directed to the temperature controller 9, 10 through the coolant discharge circuits 7, 8, and is cooled by the cooling device 11, 12. Thereafter, the cooled coolant is again supplied to the coolant supply circuits 5, 6.

Next, the coolant passages A through D in the movable die 22 will be described. FIG. 2 is a front view of the movable die 22 of the metal mold 2 according to the present embodiment. In FIG. 2, broken lines indicate the coolant passages A through D formed in the movable die 22. Incidentally, coolant paths B1 and B2 are in fluid communication with each other to provide the coolant passage B. Each of the cooling passages A through D is defined by a deep groove having a sufficient width and a partitioning plate disposed within the groove. The groove and the partitioning plate have their shapes in conformance with the cavity shape and are positioned adjacent thereto.

Figure 3:
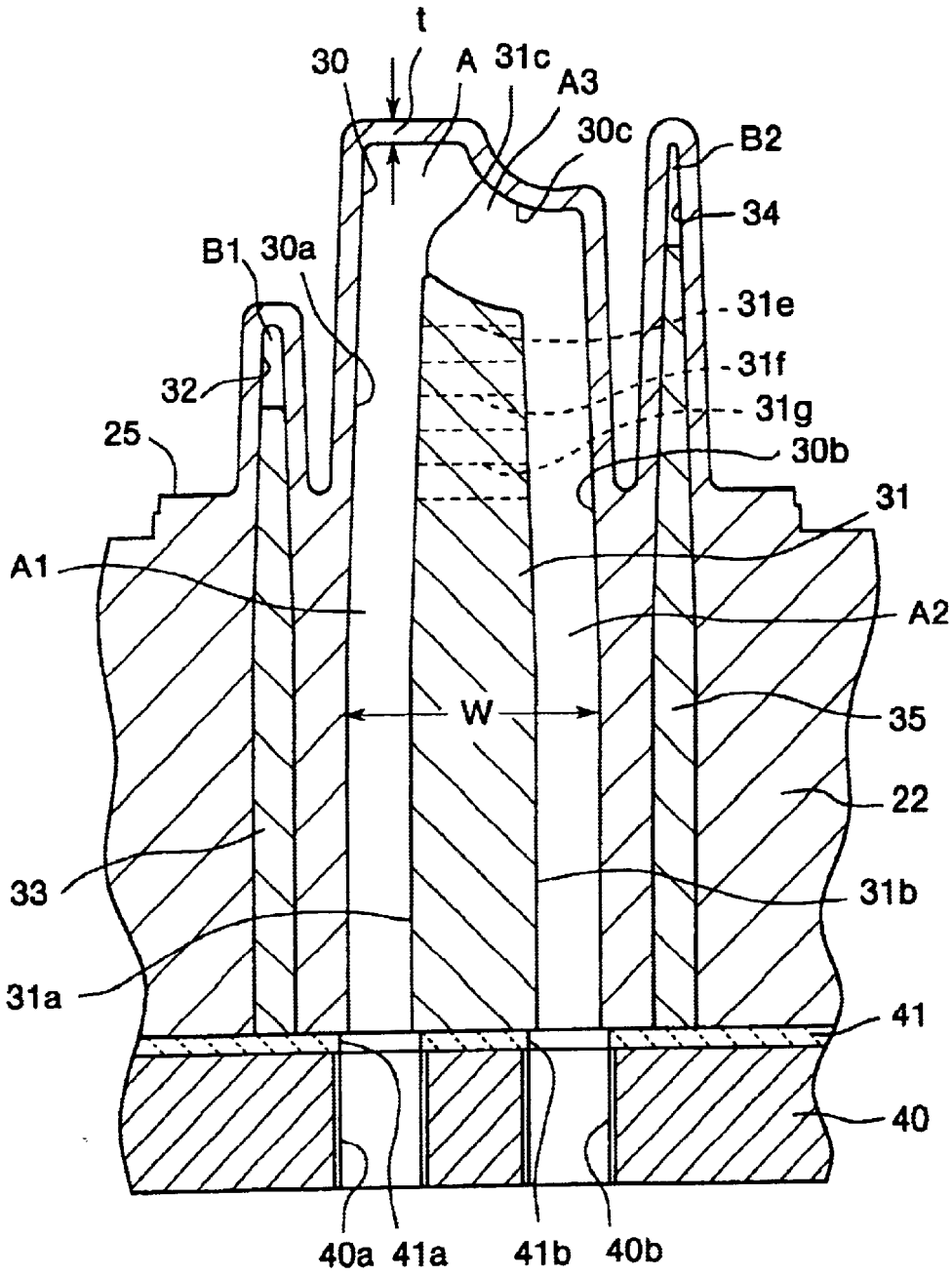
FIG. 3 is a cross-sectional view taken along the line III—III of FIG. 2.

The coolant passage A will be described. FIG. 3 is a cross-sectional view taken along the line III—III of FIG. 2. The deep groove 30 is formed from a surface of the movable die 22 opposite to the surface at which the mold cavity 25 is provided. In FIG. 3, a cross-sectional shape of the deep groove 30 is defined by a vertical wall portions 30*a*, 30*b* extending generally in parallel with each other and a bottom wall portion 30*c*. A distance W between the vertical wall portions 30*a* and 30*b* is relatively large such as from 30 to 80 mm to render the groove 30 to be wide. Further, the bottom wall portion 30*c* has a configuration in conformance with the contour of the mold cavity 25 such that a thickness t of the movable die 22 is approximately uniform along the bottom wall portion 30*c* to 3 mm. In other words, a distance between the mold cavity 25 and the bottom wall portion 30*c* is approximately 3 mm.

The partitioning plate 31 is disposed in the deep groove 30. The partitioning plate 31 is welded to the movable die 22 such that the plate 31 is set from the surface of the movable die opposite to the surface of the mold cavity 25 as if a lid is covered over the groove 30. A cross-sectional shape of the partitioning plate 31 is in conformance with the shape of the vertical wall portions 30*a*, 30*b* and the bottom wall portion 30*c* of the groove 30. More specifically, the partitioning plate 31 has vertical wall portions 31*a*, 31*b* extending approximately in parallel with the vertical wall portions 30*a*, 30*b* of the groove 30, and has a tip end portion 31*c* extending approximately in parallel with the bottom wall portion 30*c* of the groove 30. As a result, a coolant path is defined at a space provided between the partitioning plate 31 and the groove 30. To be more specific, a space between the vertical walls 30*a* and 31*a* serves as a supply path A1, a space between the bottom walls 30*c* and 31*c* serves as a main coolant path A3 for cooling a metal mold part adjacent to the mold cavity 25, and the space between the vertical walls 30*b* and 31*b* serves as discharge path A2.

Figure 4:
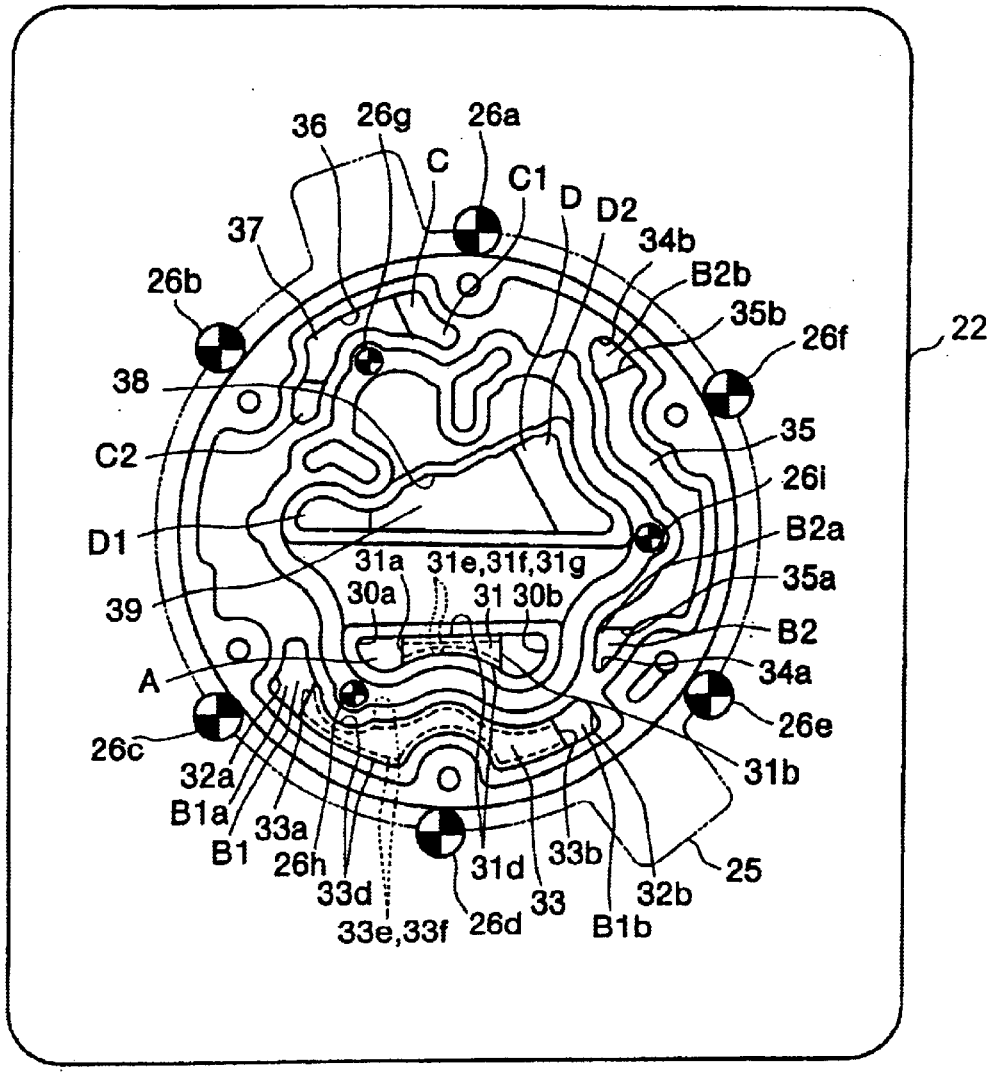
FIG. 4 is a cross-sectional view taken along the line IV—IV of FIG. 1.

As shown in FIG. 4, a pair of contact surfaces 31*d*, 31*d* defining a major outer contour of the partitioning plate 31 are in close contact with the vertical wall 30*a*, 30*b* of the groove 30. The contact surfaces 31*d* extend in the extending direction of the vertical walls 31*a*, 31*b* and are oriented approximately perpendicular to the vertical walls 31*a*, 31*b* for defining the supply path Al and the discharge path A2. The contact surfaces 31*d*, 31*d* are formed with auxiliary paths 31*e*, 31*f*, 31*g* communicating the supply path A1 with the discharge path A2. These auxiliary paths 31*e*, 31*f*, 31*g* can be provided by forming three grooves at the respective contacting surfaces 31*d*, 31*d* of the partitioning plate 31 as shown in FIGS. 3 and 4. Thus, a loop like fluid paths surrounding the partitioning plate 31 can be provided by the supply path A1, the discharge path A2 and the auxiliary paths 31*e*, 31*f*, 31*g*. As shown in FIG. 3, these auxiliary paths 31*e*, 31*f*, 31*g* are positioned only adjacent to the surface of the cavity 25. With the formation of the auxiliary paths 31*e*, 31*f*, 31*g*, the coolant passage A is branched into a plurality of paths adjacent to the mold cavity 25. Therefore, the portion in the vicinity of the surface of the cavity 25 can be more uniformly cooled, because coolant also passes through the auxiliary paths 31*e*, 31*f*, 31*g*.

A heat resistant packing 41 and a packing holder 40 are disposed at the surface of the movable die 22 opposite to the mold cavity 25 for hermetically sealing the coolant passage A. The packing 41 is formed with holes 41*a*, 41*b* at positions corresponding to open ends of the supply path A1 and the discharge path A2. The packing holder 40 is formed with connection bores 40*a*, 40*b* each formed with a female thread at positions in alignment with the holes 41*a*, 41*b*, respectively. A combination of the supply path A1, the hole 41*a* and the connection bore 40*a* corresponds to the inlet side passage a1 shown in FIG. 1, and a combination of the discharge path A2, the hole 41*b* and the connection bores 40*b* corresponds to the outlet side passage a2 shown in FIG. 1. The connection bore 40*a* is connected to the inlet side manifold 5B, and the connection bore 40*b* is connected to the outlet side manifold 7B. Incidentally, in FIG. 3, the welding portion of the partitioning plate 31 to the movable die 22 cannot be shown because the cross-sectional plane contains the connections bores 40*a*, 40*b*.

Figure 5:
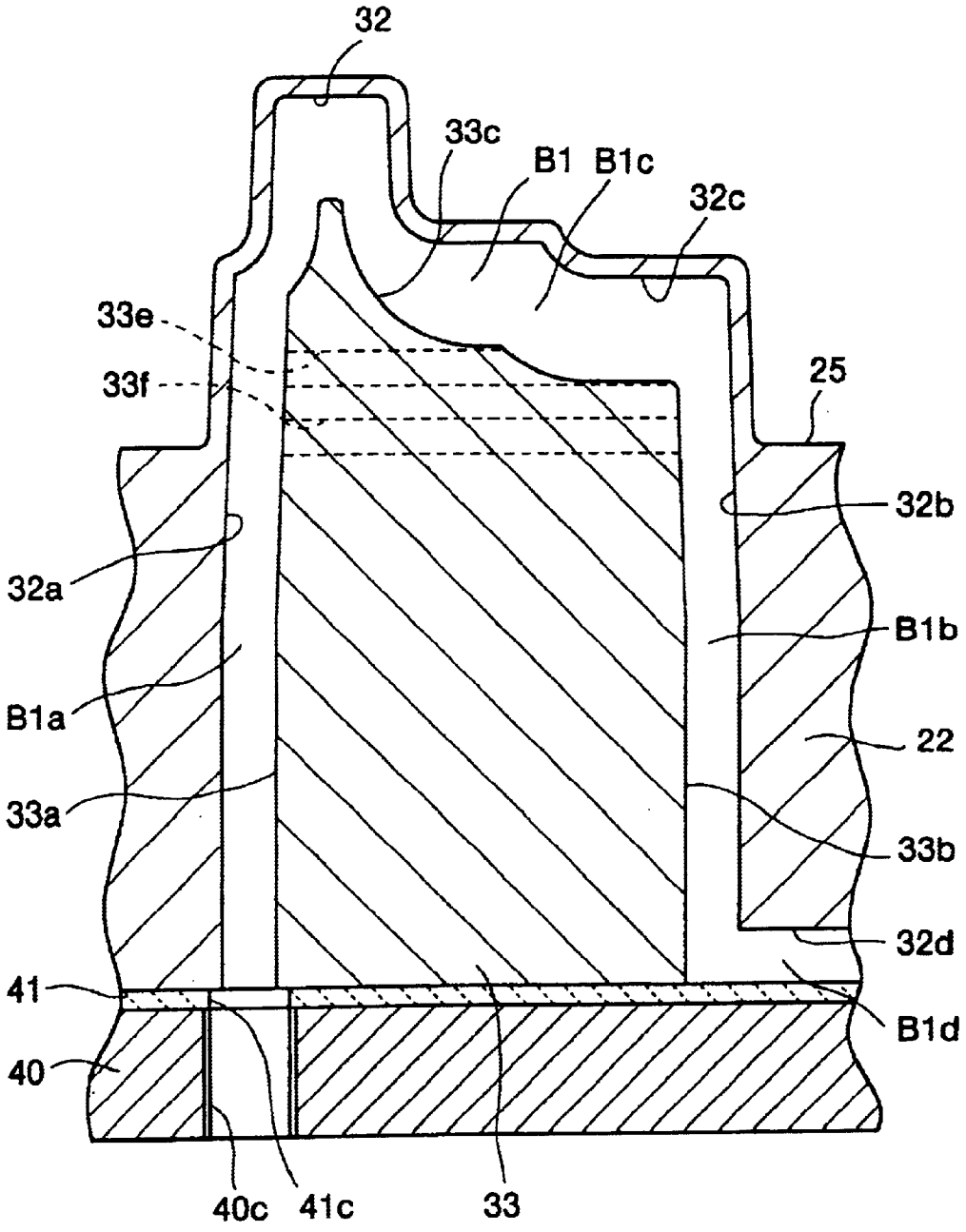
FIG. 5 is a cross-sectional view taken along the line V—V of FIG. 2.

The coolant passage B will next be described. The coolant passage B includes the coolant paths B1 and B2 as shown in FIG. 1. The coolant path B1 is defined by a deep groove 32 and a partitioning plate 33 disposed therein as shown in FIG. 5. The groove 32 has a bottom portion 32*c* whose shape is in conformance with the shape of the cavity 25, and the partitioning plate 33 has a tip end portion 33*c* whose shape is in conformance with the bottom portion 32*c*. Thus, a supply path B1*a*, a discharge path B1*b* and a main coolant path B1*c* are provided. Similar to the coolant passage A, the groove 32 has vertical wall portions 32*a*, 32*b*, and the partitioning plate 33 has vertical wall portions 33*a*, 33*b*. The partitioning plate 33 has contact surfaces 33*d* in close contact with the vertical wall portion of the groove 32, and auxiliary paths 33*e*, 33*f* are formed on the contact surfaces 33*d* similar to the auxiliary paths 31*e*, 31*f*, 31*g*. A communication path B1*d* in communication with the coolant path B2 is connected to the discharge path B1*b* of the coolant path B1. The communication path B1*d* is positioned near the surface opposite to the surface of the mold cavity 25, and is in the form of a shallow groove 32*d* independent of the shape of the mold cavity. Similar to the first coolant passage A, a hole 41*c* in communication with the supply path B1*a* is formed in the packing 41, and a connection bore 40*c* formed with a female thread and in communication with the hole 41*c* is formed in the packing holder 40. A combination of the supply path B1*a*, the hole 41*c* and the connection bore 40*c* constitute the inlet side passage b1 shown in FIG. 1. The connection bore 40*c* is connected to the inlet side manifold 5B.

Figure 6:
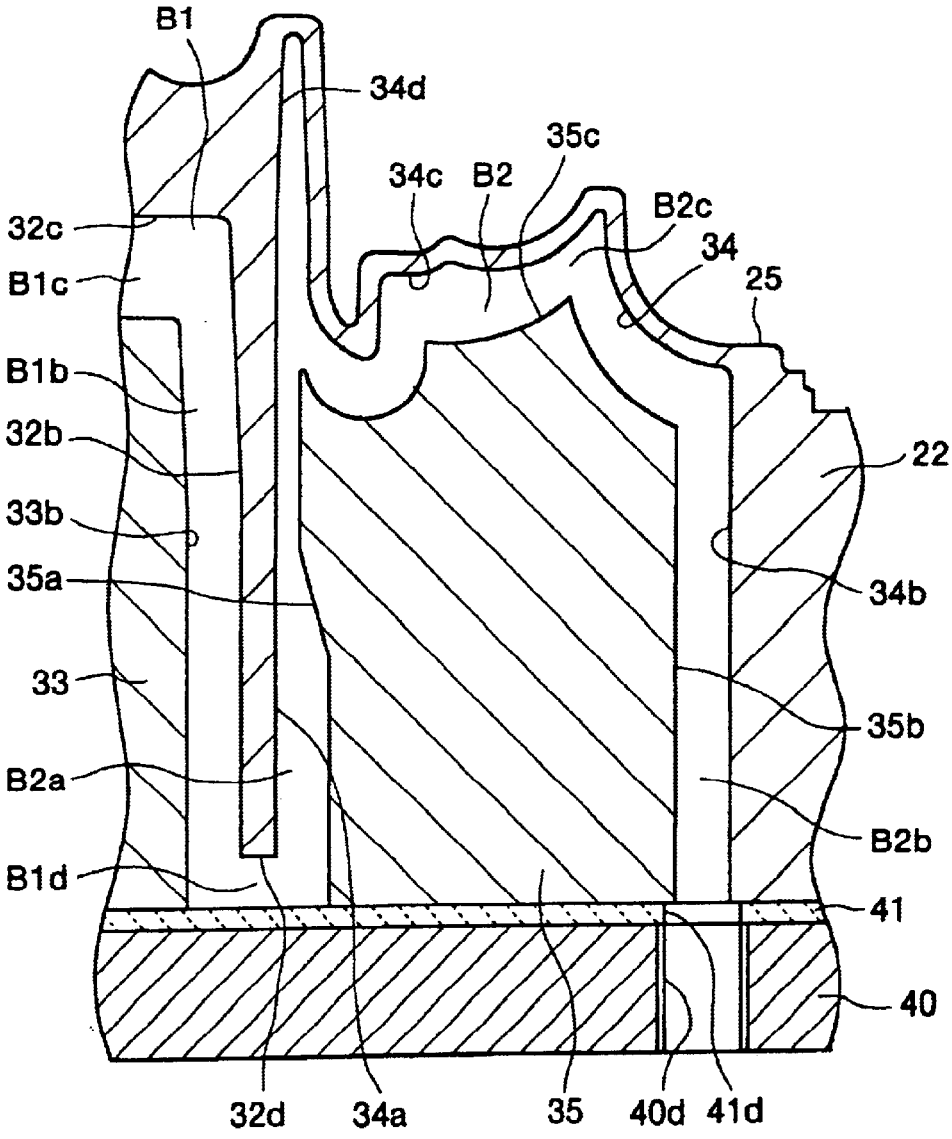
FIG. 6 is a cross-sectional view taken along the line VI—VI of FIG. 2.
Figure 7:
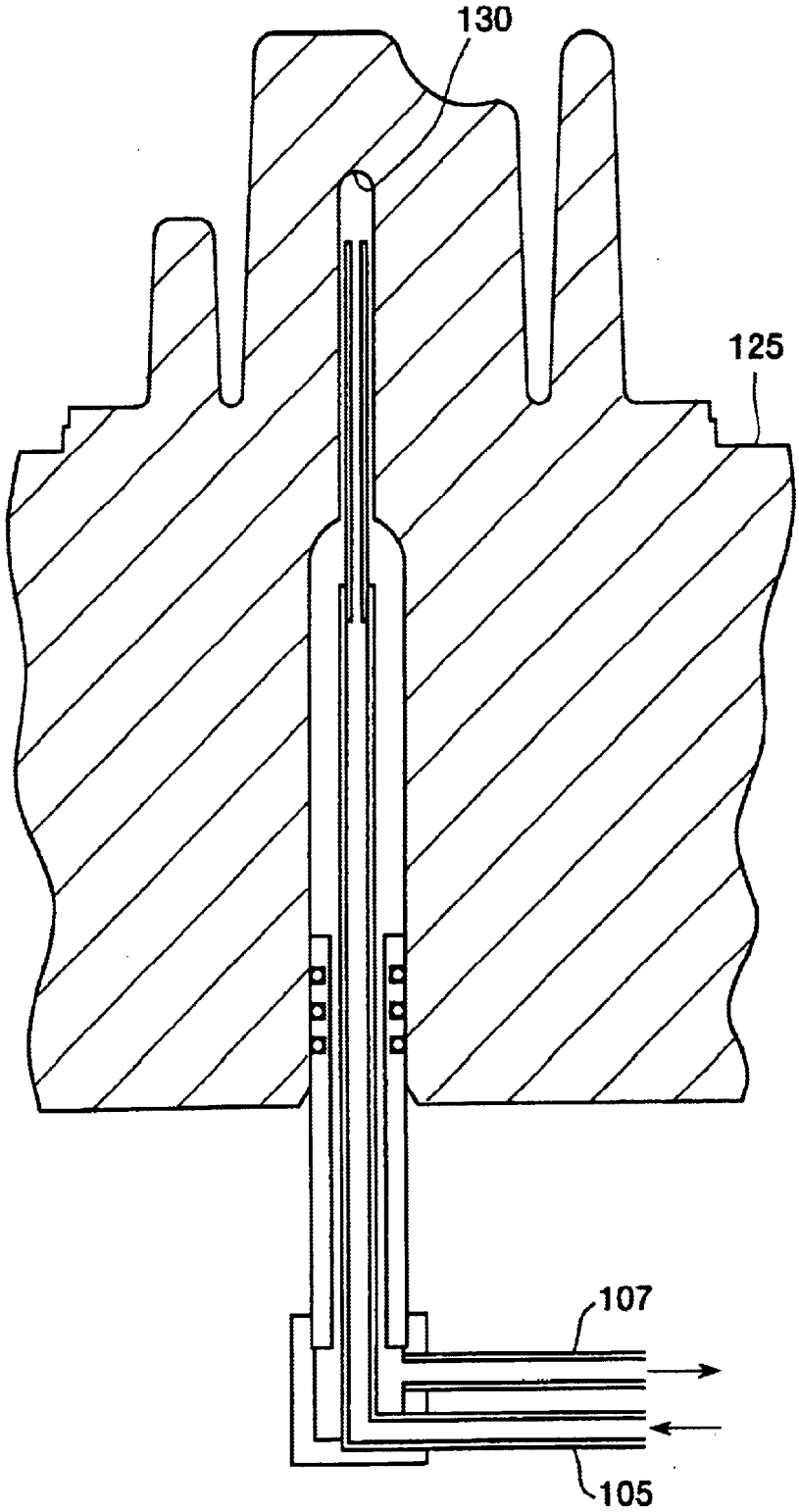
FIG. 7 is a cross-sectional view showing a conventional cooling arrangement for cooling a die-casting metal mold.

As shown in FIG. 6, the coolant path B2 is defined by a deep groove 34 and a partitioning plate 35 disposed therein. The groove 34 has a bottom portion 34*c* whose shape is in conformance with the shape of the cavity 25, and the partitioning plate 35 has a tip end portion 35*c* whose shape is in conformance with the bottom portion 34*c*. Thus, a supply path B2*a*, a discharge path B2*b* and a main coolant path B2*c* are provided. The supply path B2*a* is in communication with the communication path B1*d*, so that the coolant in the coolant path B1 is introduced into the coolant path B2. Similar to the coolant path B1, the groove 34 has vertical wall portions 34*a*, 34*b*, and the partitioning plate 35 has vertical wall portions 35*a*, 35*b*. In order to promote uniform cooling, the coolant path B2 has a supplemental cooling bore 34*d* along the surface of the cavity 25. Similar to the first coolant passage A, a hole 41*d* in communication with the discharge path B2*b* is formed in the packing 41, and a connection bore 40*d* formed with a female thread and in communication with the hole 41*d* is formed in the packing holder 40. A combination of the discharge path B2*a*, the hole 41*d* and the connection bore 40*d* constitute the outlet side passage b2 shown in FIG. 1. The connection bore 40*d* is connected to the outlet side manifold 7B.

As shown in FIG. 4, similar to the coolant passage A, the coolant passages C and D are defined by deep grooves 36, 38 at which a thickness of the movable die 22 is about 3 mm, and partitioning plates 37, 39 disposed in the deep grooves 36, 38, respectively. With the grooves and the partitioning plates, supply paths C1, D1, discharge paths C2, D2 and main coolant paths (not shown) are provided. Further, the coolant passages E, F, G are defined in the stationary die 24 in arrangements similar to the cooling passage A formed in the movable die 22.

While the invention has been described in detail and with reference to the specific embodiments thereof, it would be apparent to those skilled in the art that various changes and modifications may be made therein without departing from the scope of the invention. For example, in the depicted embodiment, the movable die 22 has four coolant passages A through D and the stationary die 24 has three coolant passages E through G. However, the numbers of the passages are not limited to these numbers, but optimum numbers and shape can be determined in accordance with the shape of the mold cavity.

Further, in the depicted embodiment, a group of the plurality of coolant passages A through D are formed in the movable die 22, and another group of the plurality of coolant passages E through G are formed in the stationary die 24. However, the coolant passage should at least be formed in the movable die. That is, the movable die generally has a complicated construction with a plurality of protrusions, whereas the stationary die generally has a plane like simple construction. If the stationary die has a plane like simple construction, the cooling to the portion of the mold cavity can be achieved by forming the coolant passage in the movable die only. In the latter case, a plurality of coolant passages are grouped into a plurality of groups, and a plurality of temperature controllers with the numbers equal to the numbers of the groups are provided. Thus, a circulation circuit including a coolant supply circuit 5 and a coolant discharge circuit 7 can be provided in connection with an associated temperature controller for each group. Thus, coolant temperature control and coolant supply control can be made in each group.

Further, in the depicted embodiment, the partitioning plates 31, 33, 35, 37, 39 disposed in the deep grooves 30, 32, 36, 38 are fixed to the die by welding. However, any fixing arrangement such as fixing with bolts and force-fitting are available.

Further, in the depicted embodiment, three auxiliary paths 31*e*, 31*f*, 31*g* are formed in the partitioning plate 31, and two auxiliary path 33*d*, 33*e* are formed in the partitioning plate 33. However, the numbers of the auxiliary paths is not limited to these numbers, but at least one auxiliary path should be formed in the partitioning plate in order to enhance cooling performance.

INDUSTRIAL APPLIABILITY

A cooling arrangement for cooling a die-casting metal mold according to the present invention is widely available in a case where uniform cooling to the entirety of the die-casting metal mold is required, or in a case where different cooling temperatures are required for different local parts of the metal mold.

What is claimed is:

1. A cooling arrangement for cooling a die-casting metal mold having a stationary die and a movable die defining a mold cavity in combination with the stationary die, the cooling arrangement including coolant passage means formed in an interior of the die-casting metal mold for allowing a coolant to pass therethrough for cooling the die-casing metal mold, the improvement wherein:

the coolant is made from an oil; and the coolant passage means comprises a plurality of coolant passages formed at least in the movable die, and each of the coolant passages is defined by a deep and wide groove and a partitioning plate disposed in the groove, each groove and each partitioning plate having shapes in conformance with a shape of the mold cavity and being positioned adjacent thereto, each partitioning plate having an outer surface formed with at least one auxiliary path at a position adjacent to the mold cavity to provide a branch flow of the coolant in each coolant passage; and a temperature controller with a cooling device is connected to each coolant passage.

2. A cooling arrangement for cooling a die-casting metal mold having a stationary die and a movable die defining a mold cavity in combination with the stationary die, the cooling arrangement including coolant passage means formed in an interior of the die-casting metal mold for allowing a coolant to pass therethrough for cooling the die-casing metal mold, the improvement wherein:

the coolant is made from an oil; and the coolant passage means comprises a plurality of coolant passages formed at least in the movable die, and each of the coolant passages is defined by a deep and wide groove and a partitioning plate disposed in the groove, each groove and each partitioning plate having shapes in conformance with a shape of the mold cavity and being positioned adjacent thereto; and a temperature controller with a cooling device is connected to each coolant passage; and wherein the plurality of coolant passages are grouped into a plurality of groups, and necessary numbers of the temperature controllers are provided in accordance with the numbers of the groups to provide, for each group, a coolant circulation circuit including a coolant supply circuit and a coolant discharge circuit with the associated temperature controller, whereby cooling control is performed independent of each group.

* * * * *